US010577173B2

(12) United States Patent
Etiz et al.

(10) Patent No.: US 10,577,173 B2
(45) Date of Patent: Mar. 3, 2020

(54) FLEXIBLE CONTAINER BAGS

(71) Applicant: ELEMENT INTERNATIONAL TRADE INC., Pointe Claire (CA)

(72) Inventors: Erhan Etiz, Pointe Claire (CA); Sukru Cenk Sayin, Toronto (CA)

(73) Assignee: ELEMENT INTERNATIONAL TRADE INC., Pointe-Claire (CA)

( * ) Notice: Subject to any disclaimer, the term of this patent is extended or adjusted under 35 U.S.C. 154(b) by 203 days.

(21) Appl. No.: 15/637,966

(22) Filed: Jun. 29, 2017

(65) Prior Publication Data

US 2018/0319584 A1 Nov. 8, 2018

Related U.S. Application Data

(60) Provisional application No. 62/501,889, filed on May 5, 2017.

(51) Int. Cl.
*B65D 88/16* (2006.01)
*B65D 90/48* (2006.01)
(Continued)

(52) U.S. Cl.
CPC ..... *B65D 88/1612* (2013.01); *B65D 19/0002* (2013.01); *B65D 71/0096* (2013.01);
(Continued)

(58) Field of Classification Search
CPC ..... B65D 88/1612; B65D 90/48; B65D 88/1625; B65D 90/12; B65D 2203/10;
(Continued)

(56) References Cited

U.S. PATENT DOCUMENTS 2,588,606 A * 3/1952 Artzt ..... A41D 1/04 2/113
5,104,236 A * 4/1992 LaFleur ..... B65D 88/1681 383/105

(Continued)

FOREIGN PATENT DOCUMENTS

CA 2955137 A1 * 1/2016 ..... B65D 88/1612
CH 710273 A1 4/2016

(Continued)

OTHER PUBLICATIONS

Extended European Search Report, regarding EP 18167622.2, completed Aug. 30, 2018.

(Continued)

*Primary Examiner* — Rafael A Ortiz
(74) *Attorney, Agent, or Firm* — BCF LLP

(57) ABSTRACT

A flexible bulk container comprising a top wall, a bottom wall, and at least one sidewall defining an internal space. There is an access portion associated with the top wall for accessing the internal space through an open end of the access portion, and a position marker located at a predetermined position on the access portion for detection by a detector of a robotic system. A stack of flexible bulk containers is also provided. An insert for use with a flexible bulk container is also provided. The insert comprises: a head portion and a tail portion extending therefrom, the head portion having an insert upper edge and the tail portion being sized and shaped for engagement with an open end of a filling spout, and lateral spacer portions extending from the head portion, one on either side of the tail portion.

19 Claims, 7 Drawing Sheets

(51) Int. Cl.
*B65D 19/00* (2006.01)
*B65D 71/00* (2006.01)

(52) U.S. Cl.
CPC ..... *B65D 90/48* (2013.01); *B65D 2203/10* (2013.01); *B65D 2588/165* (2013.01)

(58) Field of Classification Search
CPC ..... B65D 88/545; B65D 88/125; B65D 7/40; B65D 88/1668; B65D 19/0002; B65D 88/16
USPC ..... 206/386, 600; 220/1.6, 495.08
See application file for complete search history.

(56) References Cited

U.S. PATENT DOCUMENTS

| | | | | |
|---|---|---|---|---|
| 5,172,537 | A | 12/1992 | Wetter | |
| 6,067,927 | A * | 5/2000 | Johnson | G01F 23/161 116/227 |
| 8,079,200 | B2 | 12/2011 | Tsutsui et al. | |
| 8,562,274 | B2 | 10/2013 | Murray | |
| 8,684,991 | B2 | 4/2014 | Wyss | |
| 9,415,889 | B2 | 8/2016 | Albert et al. | |
| 2010/0322538 | A1* | 12/2010 | Powell | B65D 19/36 383/16 |
| 2015/0033677 | A1 | 2/2015 | Vaucher et al. | |
| 2016/0251111 | A1* | 9/2016 | Lewis | B65D 19/0018 206/386 |

FOREIGN PATENT DOCUMENTS

| | | | | |
|---|---|---|---|---|
| CN | 105015843 | A | 11/2015 | |
| CN | 105059610 | A | 11/2015 | |
| DE | 4116311 | A1 | 7/1992 | |
| DE | 102004026879 | A1 * | 2/2005 | B65D 88/1612 |
| DE | 102005011813 | A1 | 9/2006 | |
| EP | 2540629 | A1 | 1/2013 | |
| JP | H05310223 | A | 11/1993 | |
| WO | 2005002992 | A1 | 1/2005 | |
| WO | 2008064652 | A2 | 6/2008 | |
| WO | 2014055518 | A1 | 4/2014 | |

OTHER PUBLICATIONS

Partial European Search Report, regarding EP 18167622.2, completed Aug. 8, 2018.
English machine translation of DE102005011813 A1, retrieved from the EPO on Jun. 8, 2018.
English Description of EP 2540629 retrieved from Espacenet on Feb. 27, 2017.
English Description of WO 2008064652 retrieved from Espacenet on Feb. 28, 2017.
English Abstract of CN 105015843 retrieved from Espacenet on Oct. 11, 2017.
English Abstract of CH 710273 retrieved from Espacenet on Oct. 11, 2017.
English Abstract of JP H05310223 retrieved from Espacenet on Oct. 11, 2017.
English Abstract of DE 4116311 retrieved from Espacenet on Oct. 11, 2017.
English Abstract of CN 105059610 retrieved from Espacenet on Oct. 11, 2017.

* cited by examiner

FLEXIBLE CONTAINER BAGS

FIELD OF THE DISCLOSURE

The present disclosure relates to flexible container bags, specifically but not exclusively to flexible container bags for use with robotic systems.

BACKGROUND OF THE DISCLOSURE

Flexible container bags, such as those known as "flexible intermediate bulk containers", "bulk bags" or "big bags", are used to store and transport bulk materials which can be in any form such as powder, flakes or grains. The flexible container bags typically have a body made of a flexible fabric, such as a woven material, an access portion on a top face for filling the flexible container bag with the bulk material, a discharge portion on a bottom face for emptying the bulk material from the flexible container bag, and lifting straps allowing the lifting of the flexible container bags. Different forms of lifting strap exist, such as 1, 2 or 4 loops, and those known as stevedore straps. The access portion can comprise a filling spout, a skirt, a duffel top or an open top. The discharge portion can comprise a discharge spout or a flat bottom.

Sizes and capacities of flexible container bags can vary. A typical flexible container has a base surface area of about 100×100 cm and a height of about 100-200 cm. Such a bag once filled will weigh about one tonne (1000 kg) or more. Other sizes of bags can weigh between about 500 kg and about 2000 kg.

In a typical filling cycle, flexible container bags are transported empty and folded to a filling site, unfolded manually by operator(s), the filling spout of the flexible container bag engaged manually by operator(s) with a dispensing tube of a hopper containing the bulk material, and the flexible container bag filled with the bulk material through the filling spout using, for example, a gravity feed. Although the filling part of the flexible container bag can be automated to some extent, the unfolding of the folded flexible container bags and their engagement with the hopper is a manual step in existing systems and is therefore a rate delimiting step in the entire filling cycle. Time loss in the filling cycle can mean less flexible container bags filled within a given time. Time savings during the filling cycle can translate to cost savings.

Therefore, there is a need for flexible container bags which overcome or reduce at least some of the above-described problems.

SUMMARY OF THE DISCLOSURE

It is an object of the present disclosure to ameliorate at least some of the inconveniences present in the prior art.

From one aspect, there is provided a flexible bulk container comprising: a top wall, a bottom wall, and at least one sidewall, the top wall, bottom wall and the at least one sidewall defining an internal space; an access portion associated with the top wall for accessing the internal space through an open end of the access portion; and a position marker located at a predetermined position on the access portion for detection by a detector of a robotic system.

In certain embodiments, the predetermined position of the position marker is a distance or an x, y coordinate relative to at least one reference point on the access portion. By position of the position marker is meant, in certain embodiments, the position of a part of the position marker such as a corner, or an edge, or a central point, for example.

In certain embodiments, the at least one reference point is on one or more of the open end of the access portion, a side edge of the access portion, a longitudinal mark along a longitudinal dimension of the access portion, an intersection of the open end and the side edge of the access portion, and an intersection of the open end and the longitudinal mark of the access portion. The position marker can be a visually detectable mark. In certain embodiments, the position marker has a format recognisable by the detector, and is positioned on an outer surface of the access portion.

In certain embodiments, the flexible bulk container further comprises a removeable insert which is sized and shaped to position the access portion at a predetermined position relative to at least one of an upper fold edge, a lower fold edge or side fold edges of the flexible bulk container, when the flexible bulk container is empty and folded with the access portion laying on an upper fold face of the folded flexible bulk container.

In certain embodiments, the insert comprises: a head portion, and a tail portion extending from the head portion, for spacing the access portion from the upper fold edge of the folded flexible bulk container, the head portion having an insert upper edge and the tail portion being sized and shaped for engagement with the open end of the access portion, and lateral spacer portions extending from the head portion, one on either side of the tail portion, for spacing the access portion from the side fold edges of the folded flexible bulk container when the flexible bulk container is empty and folded.

In certain embodiments, at least a portion of the access portion on which the position marker is located has a stiffness sufficient to present a substantially flat upwardly facing surface when the flexible bulk container is empty and is folded. This can be achieved by using fabric of an appropriate thickness, by lamination, or by a combination of fabric thickness and lamination.

In certain embodiments, the at least a portion of the access portion on which the position marker is located is formed from a fabric having a weight of between about 70 to about 200 g/m$^2$, about 70 to about 240 g/m$^2$, about 70 to about 230 g/m$^2$, about 70 to about 220 g/m$^2$, about 70 to about 210 g/m$^2$, about 75 to about 240 g/m$^2$, about 75 to about 230 g/m$^2$, about 75 to about 220 g/m$^2$, about 75 to about 210 g/m$^2$, 75 to about 190 g/m$^2$, about 75 to about 180 g/m$^2$, about 75 to about 170 g/m$^2$, about 75 to about 160 g/m$^2$, about 75 to about 150 g/m$^2$, about 75 to about 140 g/m$^2$, about 75 to about 135 g/m$^2$, about 75 to about 130 g/m$^2$, about 100 to about 150 g/m$^2$, about 110 to about 140 g/m$^2$, or about 135 g/m$^2$.

In certain embodiments, substantially the entire access portion is formed from a fabric of sufficient stiffness to present a substantially flat upwardly facing surface when the flexible bulk container is empty and is folded. In certain embodiments, substantially the entire filling spout is laminated, or at least a portion of the access portion on which the position marker is located is laminated.

In certain embodiments, at least a portion of the access portion on which the position marker is located has a stiffness sufficient to present a substantially flat upwardly facing surface when the flexible bulk container is empty and is folded, the at least a portion of the access portion on which the position marker is located being made of a fabric having a weight of about 70 to about 240 g/m$^2$ or about 75 to about 150 g/m$^2$, and the at least a portion of the access portion on which the position marker is located being laminated. By upwardly facing surface is meant the surface which is exposed when the flexible bulk container is empty and is folded.

In certain embodiments, the access portion is a filling spout extending from the top wall, at least a portion of the filling spout on which the position marker is located being laminated and/or being formed from a fabric having a weight of between about 70 to about 240 g/m$^2$, the predetermined position of the position marker being a distance from one or more of the open end of the filling spout, a side edge of the filling spout when the filling spout is folded flat, a longitudinal mark along a longitudinal dimension of the filling spout, an intersection of the open end of the filling spout and the side edge of the filling spout, and an intersection of the open end of the filling spout and the longitudinal dimension of the filling spout. In certain embodiments, the longitudinal mark is a stitch mark along the longitudinal dimension of the folded filling spout, the stitch mark having a different colour than the outer surface of the filling spout. In certain embodiments, the stitch mark has a contrasting colour to that of the filling spout. In certain embodiments, the predetermined position of the position marker is a pre-defined distance from the open end of the filling spout, in a direction from the open end towards a base of the filling spout, and an equidistant distance from oppositely facing side edges of an exposed face of the filling spout when the filling spout is folded and laid flat against an upper fold face of the flexible bulk container. The filling spout can be folded from its base.

The entire filling spout may be laminated, with at least one layer of a polymer such as polyethylene. The lamination may have a weight of 30 g/m$^2$. In certain embodiments, the filling spout is made of a polypropylene fabric having a weight of 135 g/m$^2$ and having a polyethylene lamination of 30 g/m$^2$. In certain embodiments, the combination of at least two of the weight of the filling spout, the weight of the lamination combination and the insert, provides a stiffness to the filling spout which is sufficient to maintain a degree of flatness to the position marker for detection by a robotic system.

In certain embodiments, the visual mark has a contrasting colour to that of the outer surface of the filling spout. The visual mark can be a black strip. The visual mark can be attached to or formed on the outer surface of the filling spout. The visual mark can be any other colour. The black strip can be attached to the filling spout by stitching. The black strip can be positioned with its longitudinal axis substantially perpendicular to the longitudinal axis of the filling spout. The position marker can help to position a robotic arm of a robotic system to grip a folded flexible bulk container at the filling spout only. In these embodiments, the position marker functions as a reference point for the robotic arm, which can be made to move predetermined distances and directions from the reference point.

In certain embodiments, the flexible bulk container further comprises a removeable insert, the insert comprising: a head portion with an insert upper edge, a tail portion extending from the head portion for insertion into the open end of the filling spout, and lateral spacer portions extending from the head portion, one on either side of the tail portion, the tail portion having a width, defined by a distance between two tail portion side edges, sufficient to allow it to be received in the filling spout and wide enough to maintain at least a portion of the filling spout substantially flat, when the tail portion is received in the filling spout when the flexible bulk container is empty and folded. In certain embodiments, the lateral spacer portions of the insert are sized and shaped to position the folded filling spout substantially centrally between the two side fold edges of the folded flexible bulk container. In certain embodiments, a width of the insert is the same or slightly smaller than the distance between the side fold edges of the folded flexible bulk container. The insert may have an upper edge which is substantially perpendicular to one or more of the tail side edges or insert side edges of the spacer portions. The insert may have an upper edge which is substantially perpendicular to a longitudinal axis of one or more of the tail portion or the lateral spacer portion.

The insert can further comprise one or more features selected from: slots extending from the insert upper edge towards the tail portion for receiving at least one folded portion of the folded flexible bulk container; holes defined in the head portion; and a flap on at least one of the lateral spacing portions for engagement with at least one folded portion of the folded flexible bulk container.

In certain embodiments, the position marker is a visual mark having a contrasting colour to that of the outer surface of the filling spout, and is attached to or formed on the outer surface of the filling spout.

From another aspect, there is provided a flexible bulk container comprising: a top wall, a bottom wall, and at least one sidewall, the top wall, bottom wall and the at least one sidewall defining an internal space; a filling spout extending from the top wall and having one open end in fluid communication with an opening in the top wall for accessing the internal space through the filling spout, and a position marker detectable by a detector of a robotic system, the position marker being located at a predetermined distance from the open end of the filling spout.

From yet another aspect, there is provided a flexible bulk container comprising: a top wall, a bottom wall, and at least one sidewall, the top wall, bottom wall and the at least one sidewall defining an internal space; a filling spout extending from the top wall and having one open end in fluid communication with an opening in the top wall for accessing the internal space through the filling spout, and a position marker on an outer surface of the filling spout, the position marker being located on an upwardly facing folded surface of the filling spout when the flexible bulk container is folded, the position marker being detectable by a detector of a robotic system. In certain embodiments, the predetermined position of the position marker is a predefined distance from the open end of the filling spout, in a direction from the open end towards a base of the filling spout, and equidistant from oppositely facing side edges of the filling spout when the filling spout is folded and laid flat against an upper fold face of the flexible bulk container.

From a further aspect, there is provided a stack of flexible bulk containers comprising a plurality of flexible bulk containers, each flexible bulk container comprising: a top wall, a bottom wall, and at least one sidewall, the top wall, bottom wall and the at least one sidewall defining an internal space; an access portion associated with the top wall for accessing the internal space through an open end of the access portion; and a position marker located at a predetermined position on the access portion for detection by a detector of a robotic system; each flexible bulk container having a folded form comprising an upper fold edge, a lower fold edge and two side fold edges, with the access portion folded and laying on an upper fold face of the folded flexible bulk container, the position marker on the access portion facing outwardly, each one of the plurality of the flexible bulk containers of the stack laying one on top of another.

In certain embodiments, each one of the plurality of flexible bulk containers of the stack has a lower fold face and the flexible bulk containers of the stack can be stacked such that the lower fold face of one flexible bulk container lies against an upper fold face of an adjacent flexible bulk container, and with the upper fold face of each one of the flexible bulk container of the stack oriented alternately, relative to an adjacent one of the flexible bulk container of the stack. By alternately is meant that the flexible bulk containers can be stacked in a head-to-tail configuration. In this regard, the upper fold face of each one of the flexible bulk container of the stack may be oriented at approximately 180° relative to an adjacent one of the flexible bulk container of the stack. In other words, the stack of flexible bulk containers can comprise one folded flexible bulk container layered on top of another folded flexible bulk container, the upper fold face of each of the folded flexible bulk containers facing in the same direction (e.g. upwardly). Expressed in a different way, the stack can comprise a first folded flexible bulk container having a first orientation, and stacked on top of an adjacent second folded flexible bulk container having a second orientation, the first and second orientations being substantially 180° to each other.

In certain embodiments, each one of the plurality of flexible bulk containers of the stack further comprises a removeable insert which is sized and shaped to position the access portion at a predetermined position relative to at least one of an upper fold edge, a lower fold edge or side fold edges of the flexible bulk container when the flexible bulk container is empty and folded with the access portion laying on an upper fold face of the folded flexible bulk container, the removeable insert comprising: a head portion, and a tail portion extending from the head portion, for spacing the access portion from the upper fold edge of the folded flexible bulk container, the head portion having an insert upper edge and the tail portion being sized and shaped for engagement with the open end of the access portion, and lateral spacer portions extending from the head portion, one on either side of the tail portion, for spacing the access portion from the side fold edges of the folded flexible bulk container when the flexible bulk container is empty and folded. In certain embodiments, the tail portion of the insert extends into the open end of the access portion, at least a portion of the head portion of the insert extending from the upper fold edge, and the lateral spacer portions lying on either side of the access portion on the upper fold face of the folded flexible bulk container. In certain embodiments, folded flexible bulk containers are assembled to form the stack such that the stack is substantially cuboid in shape.

In certain embodiments, the access portion is a filling spout. The filling spout may have a substantially cylindrical form and be folded flat along a longitudinal axis.

In certain embodiments, the stack further comprises a pallet on which the plurality of flexible bulk containers are stacked, and a rack positioned over an upper-most folded flexible bulk container. In certain embodiments, the stack further comprises at least one outer strap connecting the pallet and the rack. The rack may include at least one guide extending across a top surface of the panel for receiving a portion of the at least one outer strap, which may help to retain the position of the at least one outer strap. Each guide may comprise a pair of parallel rails. In certain embodiments, the stack further comprises at least one cover extending over the folded flexible bulk containers and positioned under or over the at least one outer strap. In certain embodiments, the stack comprises one or more of a lower cover extending from the pallet upwardly (from a lowermost folded flexible bulk container of the stack to the uppermost folded flexible bulk container of the stack), and an upper cover extending from the uppermost folded flexible bulk container of the stack downwardly. The upper cover may be positioned beneath the rack. The outer strap(s) may extend over the one or more of the lower cover and the upper cover.

In certain embodiments, the stack may further comprise at least one inner strap around the plurality of flexible bulk containers. The at least one inner strap may contribute to maintaining the plurality of flexible bulk containers in a compressed form.

From a yet further aspect, there is provided an insert for use with a flexible bulk container, the flexible bulk container comprising a top wall, a bottom wall, and at least one sidewall, the top wall, bottom wall and the at least one sidewall defining an internal space; and an access portion associated with the top wall for accessing the internal space through an open end of the access portion, the insert comprising: a head portion and a tail portion extending therefrom, the head portion having an insert upper edge and the tail portion being sized and shaped for engagement with the open end of the access portion, and lateral spacer portions extending from the head portion, one on either side of the tail portion.

In certain embodiments, the tail portion has a width, defined by a distance between two tail portion side edges, sufficient to allow it to be received in the access portion and wide enough to maintain at least a portion of the access portion substantially flat, when the tail portion is received in the access portion when the flexible bulk container is empty and folded.

In certain embodiments, the access portion is a filling spout having a position marker located at a predetermined position on the access portion for detection by a detector of a robotic system, the lateral spacer portions of the insert being sized and shaped to position the folded filling spout substantially centrally between two side fold edges of the folded flexible bulk container.

In certain embodiments, the insert further comprises one or more features selected from: slots extending from the insert upper edge towards the tail portion for receiving at least one folded portion of the folded flexible bulk container; holes defined in the head portion; and a flap on at least one of the lateral spacing portions for engagement with at least one folded portion of the folded flexible bulk container.

In certain embodiments, the insert comprises slots extending from the insert upper edge towards the tail portion for receiving at least one folded portion of the folded flexible bulk container. This embodiment of insert can be used with flexible bulk containers having a length which when folded in half exceeds a dimension of a pallet on which the folded flexible bulk container will be stored.

In certain embodiments, the insert has holes defined in the head portion. This embodiment of insert can contribute to flat packing of the folded flexible container bags in the stack. In certain embodiments, the insert has a flap on each lateral spacing portion for engagement with at least one folded portion of the folded flexible bulk container.

From a further aspect, there is provided a folded flexible bulk container, according to any of the embodiments described herein, the folded flexible bulk container comprising an upper fold face, an upper fold edge, a lower fold edge and a side fold edges, wherein the filling spout is folded along a longitudinal length and laid against the upper fold edge. In certain embodiments, a fold of the filling spout is substantially parallel to the longitudinal marker of the filling spout. In certain embodiments, the position marker of the folding spout is upwardly facing when the filling spout is folded onto the upper fold face. In certain embodiments, the folded flexible bulk container includes an insert, according to any of the embodiments described herein, with the tail portion extending into the filling spout, and the head portion protruding from the filling spout outer edge.

From a further aspect, there is provided a robotic system for unpacking of a stack of folded flexible bulk containers, according to any of the embodiments described herein, the robotic system comprising a detector for detecting a position of the position marker of an uppermost folded flexible bulk container of the stack of folded flexible bulk containers, a processor in communication with the detector for controlling a first robotic arm for gripping the uppermost folded flexible bulk container of the stack, and a second robotic arm for gripping and removing the insert of the uppermost folded flexible bulk container of the stack. In certain embodiments, the processor is arranged to store instructions on how to move the first and second robotic arms relative to the detected position marker. The robotic system is arranged to engage the unpacked uppermost flexible bulk container with a filling system, such as a hopper.

From a yet further aspect, there is provided a computer program comprising instructions for causing the robotic system to grip and unpack the uppermost folded flexible bulk container of the stack, according to any of the embodiments as described above.

From a yet further aspect, there is provided a method for unpacking a stack of folded flexible bulk containers, according to any of the embodiments described herein, the method comprising providing a stack of folded flexible bulk containers (optional), detecting a position of the position marker of an uppermost folded flexible bulk container of the stack of folded flexible bulk containers, and providing the position to a processor in communication with the detector, the processor controlling a first robotic arm for gripping the uppermost folded flexible bulk container of the stack at the filling spout and lifting the uppermost folded flexible bulk container away from the stack, and a second robotic arm for gripping and removing the insert of the uppermost folded flexible bulk container of the stack. In certain embodiments, the first robotic arm is arranged to grip the filling spout at a position which is spaced from the position marker towards the base of the filling spout. In certain embodiments, the first robotic arm grips the filling spout clear of the insert, so that the insert is not gripped. This can help with the removal of the insert by the second robotic arm.

By means of certain aspects and embodiments, an automated unpacking of flexible bulk containers is provided. By means of certain aspects and embodiments of the present disclosure, an automated attachment of flexible bulk containers to hoppers for filling is provided. Automation of at least the unpacking of the flexible container bags and their attachment to a hopper can provide time savings, enabling more flexible container bags to be unpacked from a stack of flexible container bags for attachment to a hopper, when compared with a manual method. This can therefore translate to costs savings. The automation of the unpacking according to certain embodiments of the present disclosure can also limit the exposure of human workers to certain dangers and work-related injuries.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example "A and/or B" is to be taken as specific disclosure of each of (i) A, (ii) B and (iii) A and B, just as if each is set out individually herein.

BRIEF DESCRIPTION OF DRAWINGS

Further aspects and advantages of the present invention will become better understood with reference to the description in association with the following in which.

DETAILED DESCRIPTION

Figure 1A:
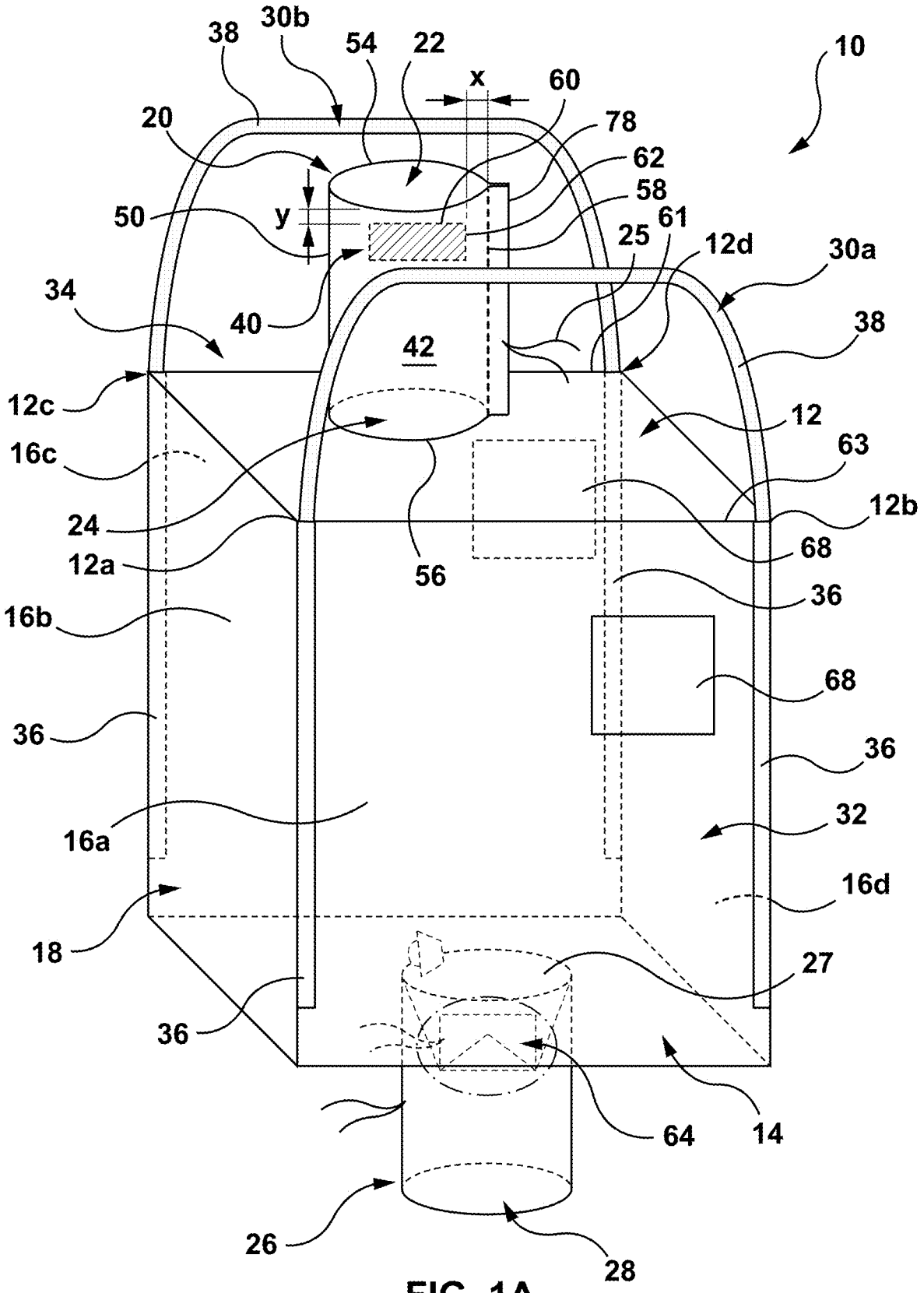
FIG. 1A is a perspective view of flexible container bag, in an unfolded state, when viewed from a front end, according to an embodiment of the present disclosure.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

Broadly, there is provided a flexible bulk container which is suitable for automated unfolding. Specifically, the flexible bulk container detection is suitable for handling by a robotic system whilst in a folded state on a stack of flexible bulk containers. In the embodiment described below, the robotic system is arranged to lift or unpack an uppermost flexible bulk container from the stack of folded bulk containers, for engagement with a filling system for filling the flexible bulk container with bulk material.

Referring initially to FIG. 1, according to one embodiment, there is provided a flexible bulk container 10 having a top wall 12, a bottom wall 14, and sidewalls 16*a*, 16*b*, 16*c* and 16*d* defining a generally cuboidal-shaped body. The top wall 12, bottom wall 14 and the sidewalls 16*a*, 16*b*, 16*c*, and 16*d* define an internal space 18. The top wall 12 has an access portion 20 associated therewith, in the form of a filling spout 20. The internal space 18 can be accessed through an open end 22 of the filling spout 20 and a top wall opening 24 defined in the top wall 12. A tie 25 is provided in conventional manner to close the filling spout 20. The bottom wall 14 has a discharge spout 26 extending from the bottom wall 14 and through which bulk material (not shown) stored in the flexible bulk container 10 can be discharged through an opening 27 in the bottom wall 14 and an open end 28 of the discharge spout 26. In alternative embodiments, the flexible bulk container 10 has a cylindrical shaped body and a single cylindrical side wall instead of the side walls 16*a*, 16*b*, 16*c* and 16*d*. In other alternative embodiments, the discharge spout 26 is omitted. In other embodiments, a closure mechanism different than those illustrated for the filling spout 20 and/or the discharge spout 26 is provided.

Two lifting loops 30*a*, 30*b* are provided extending from the top wall 12 of the flexible bulk container 10. One lifting loop 30*a* extends between adjacent corners 12*a*, 12*b* of the top wall 12 along a front end 32 of the flexible bulk container 10. The other lifting loop 30*b* extends between adjacent corners 12*c*, 12*d* of the top wall 12 along a back end 34 of the flexible bulk container 10. As can be seen in FIG. 1, an end portion 36 of each of the lifting loops 30*a*, 30*b* are attached to, or integral with, the side walls 16*a*, 16*b*, 16*c* and 16*d*. A handle portion 38, between two end portions 36, of each of the lifting loops 30*a*, 30*b* extend from the side walls 16*a*, 16*b*, 16*c* and 16*d* and are of equal length. In this embodiment, the handle portion 38 of each lifting loop is 115 cm. These types of lifting loops are referred to in the art as 'Stevedore straps'. In other embodiments, the lifting loops 30*a*, 30*b* can be of any other suitable length. In other embodiments, the lifting loops 30*a*, 30*b* can be of any other configuration such as four separate loops extending from each of the corners 12*a*, 12*b*, 12*c*, and 12*d*, a single diagonal loop, or any other number or configuration of loop or strap.

Figure 1B:
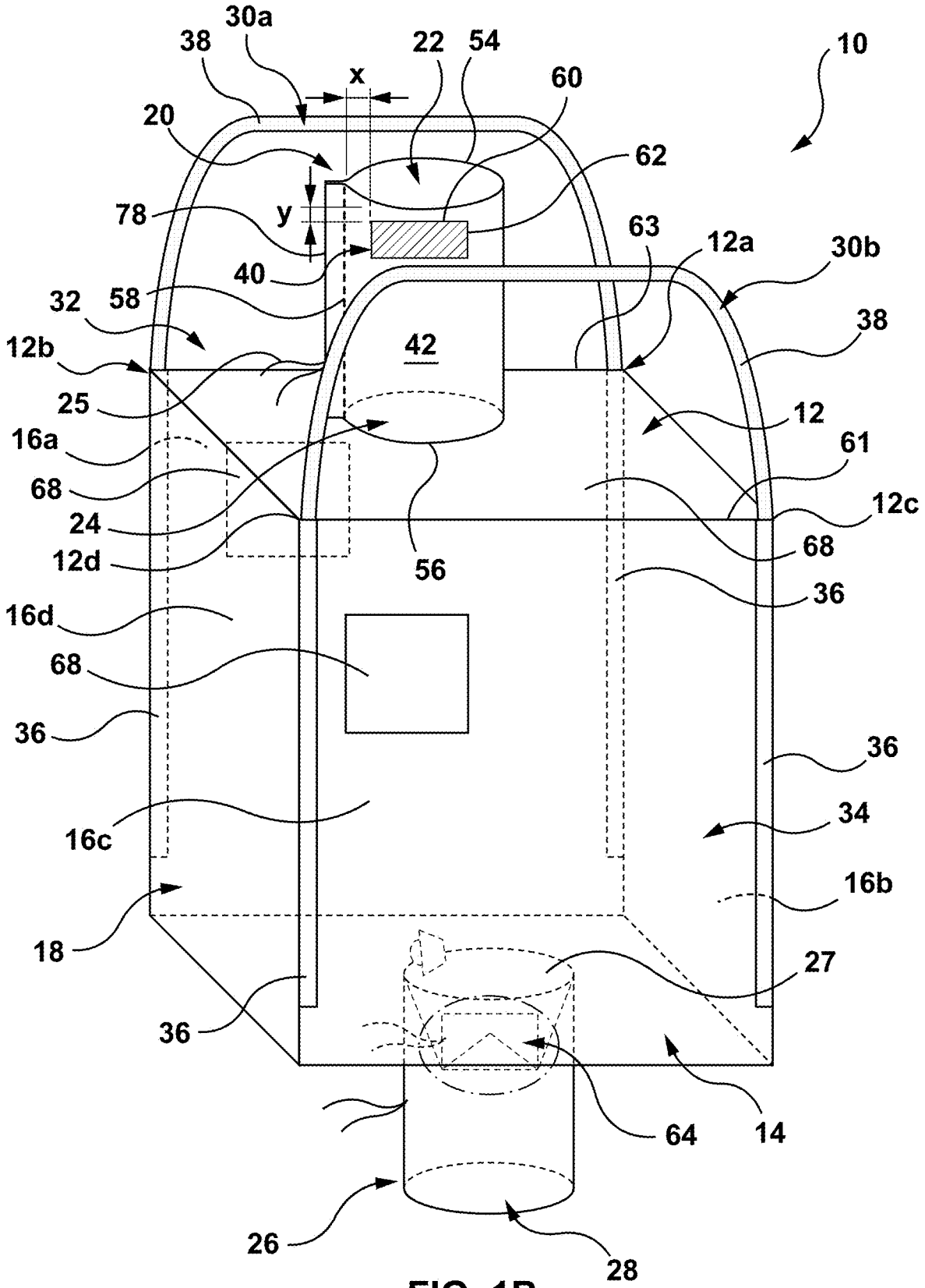
FIG. 1B is a perspective view of the flexible container bag of 1A when viewed from a back end, according to an embodiment of the present disclosure.
Figure 6:
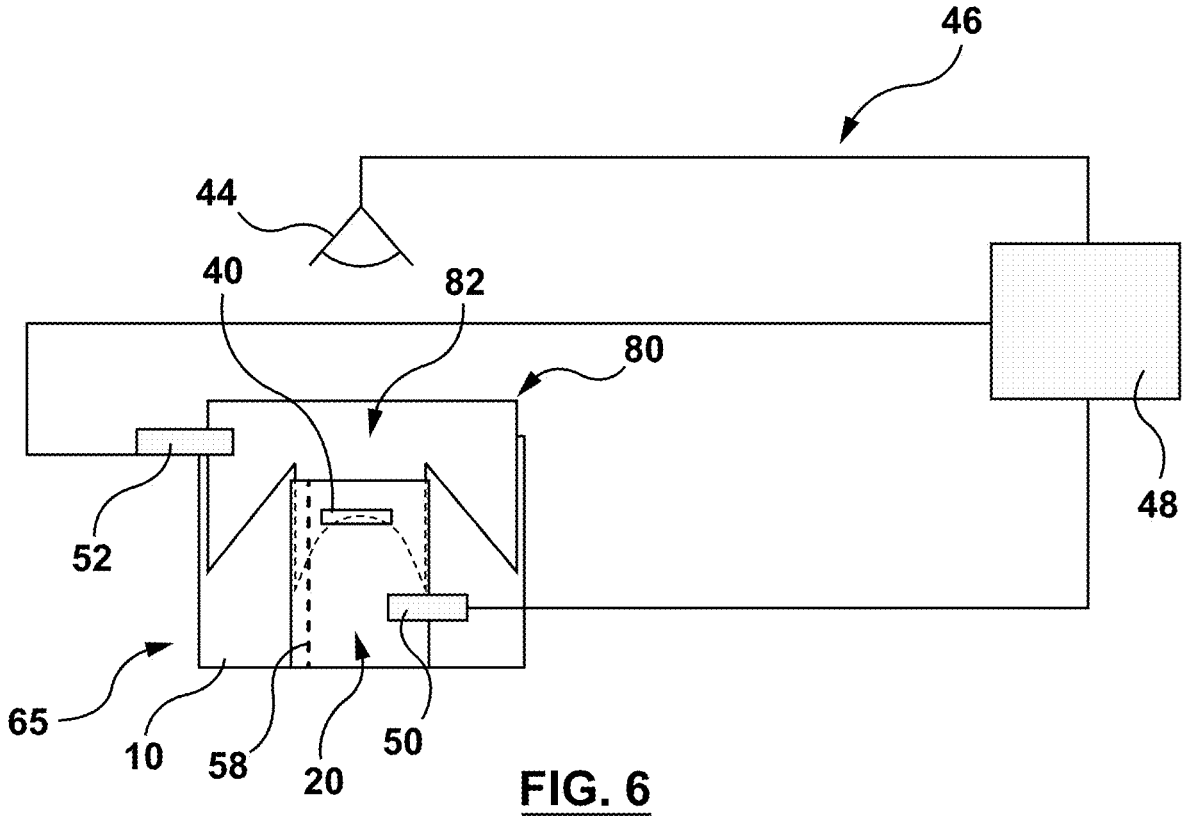
FIG. 6 illustrates a robotic system for automated unfolding of the flexible container bag of FIG. 3, according to an embodiment of the present disclosure.

The filling spout 20 has a generally cylindrical form and includes a position marker 40 located at a predetermined position on an outer surface 42 of the filling spout 20. As illustrated in FIG. 1A and FIG. 1B, the position marker is on the back end 34 of the flexible bulk container 10. The position marker 40 is arranged to be detectable by a detector 44 of a robotic system 46 at a filling site (FIG. 6). In this embodiment, the detector 44 is an optic eye, or any other detection system, connectable to a processor 48 which is arranged to control robotic arms 50, 52 (also referred to as first robotic arm 50, and second robotic arm 52).

The position marker 40 is a machine detectable mark. In this embodiment, the position marker 40 is visually detectable by the detector 44 of the robotic system 46 for automated unpacking and filling. The position marker 40 is a strip having a colour (black) which is in contrast to the outer surface 42 (white) of the filling spout 20. Other contrasting colour combinations are possible. The position marker 40 is a separate piece of material which is attached to the outer surface 42 of the filling spout 20 by stitching. In this embodiment, the position marker 40 is a rectangular piece of material made of polypropylene, but can be made of any other suitable material. In other embodiments, the position marker 40 is attached to the filling spout 20 in any other way such as by laminating, gluing, heat bonding, painting, dyeing or by using attachment means such as rivets, staples, bolts etc. In other embodiments, the position marker 40 is formed integrally with the filling spout 20.

In other embodiments, the visually detectable position marker 40 has a different shape or colour than the rectangular shape shown in FIGS. 1-3 and 6, such as square, triangular, circular, or comprises a patterned configuration such as a bar code, or the like. In other embodiments, the position marker 40 is a mark which is detectable by another electromagnetic signal detector, such as radio signal detector, an infrared detector, x-ray detector, or the like. In other embodiments, the position marker 40 is an active tag and has a transmitter to emit signals. In other embodiments, the position marker 40 is a passive tag and is arranged to reflect signals to the detector 44. In one embodiment, the position marker 40 is a RFID tag.

The predetermined position of the position marker 40 on the outer surface 42 of the filling spout 20 is a distance from two reference points on the filling spout 20, as an x, y coordinate for example. In this respect, the filling spout 20 has a substantially cylindrical body 50 having an outer edge 54 defining the open end 22. The filling spout is 20 is tapered towards a base 56 of the filling spout 20. The y coordinate is a predetermined distance from the filling spout outer edge 54 in a direction towards the base 56 of the filling spout 20. A longitudinal marker 58, extending in a direction along the length of the filling spout 20 from the filling spout outer edge 54 towards the base 56, represents another reference point. The x coordinate is a predetermined distance from the longitudinal marker 58 in a radial direction around the cylindrical body of the filling spout 20. The longitudinal marker 58 is a stitch line. In this embodiment, the cylindrical form of the body is created by folding a rectangular blank of material on itself and stitching along the stitch line. The stitch line has a contrasting colour to that of the outer surface 42 of the filling spout 20. The predetermined position also defines an orientation of the position marker 40, such as the position marker being aligned along its length with the filling spout outer edge 54. In this embodiment, the distance "y" from the filling spout outer edge 54 to the position marker is about 13 to about 16 cm. In other words, an upper edge 60 of the position marker 40 is positioned about 13 to about 16 cm from the filling spout outer edge 54. In this embodiment, the position marker 40 is 5×40 cm, although other shapes and dimensions of the position marker 40 are possible.

The longitudinal marker 58 also assists in positioning of the filling spout 20 relative to the top wall 12, when forming the flexible bulk container 10, as well as helping with the positioning of the filling spout 20 during folding of the flexible bulk container 10. In this respect, the filling spout 20 is positioned substantially centrally on the top wall 12 when folded. The flexible bulk container 10 is formed such that a distance from the longitudinal marker 58 to an upper edge 61 of the top wall 12 is equidistant to a distance from the longitudinal marker 58 to a lower edge 63 of the top wall 12. In this embodiment, the distance is about 55 cm. In other embodiments, the predetermined position of the position marker 40 can be defined in any other way, for example, as a distance from one or more reference points on the filling spout 20 or on the flexible bulk container 10. In one embodiment, the reference point is an intersection of the longitudinal marker 58 and the outer edge 54, and the predetermined position is a distance from the reference point, which can be an x, y distance.

The discharge spout 26 of the flexible bulk container 10 has a conventional form, and can be closed and opened using a closing system 64 comprising conventional means such as flaps and ties, as known to persons skilled in the art, and so will not be described further.

The flexible bulk container 10 is made from a material having mechanical properties which allow the folding of the flexible bulk container 10, and strong enough to store and lift material such as grain. In this embodiment, the flexible bulk container 10 is made from a woven polypropylene, using for example a Sulzer weave. Alternatively, the flexible bulk container 10 can be made from any other material suited for the intended end use of the flexible bulk container 10, or from any other weave such as flat weave/flat fabric, or circular weave/circular fabric.

Figure 5:
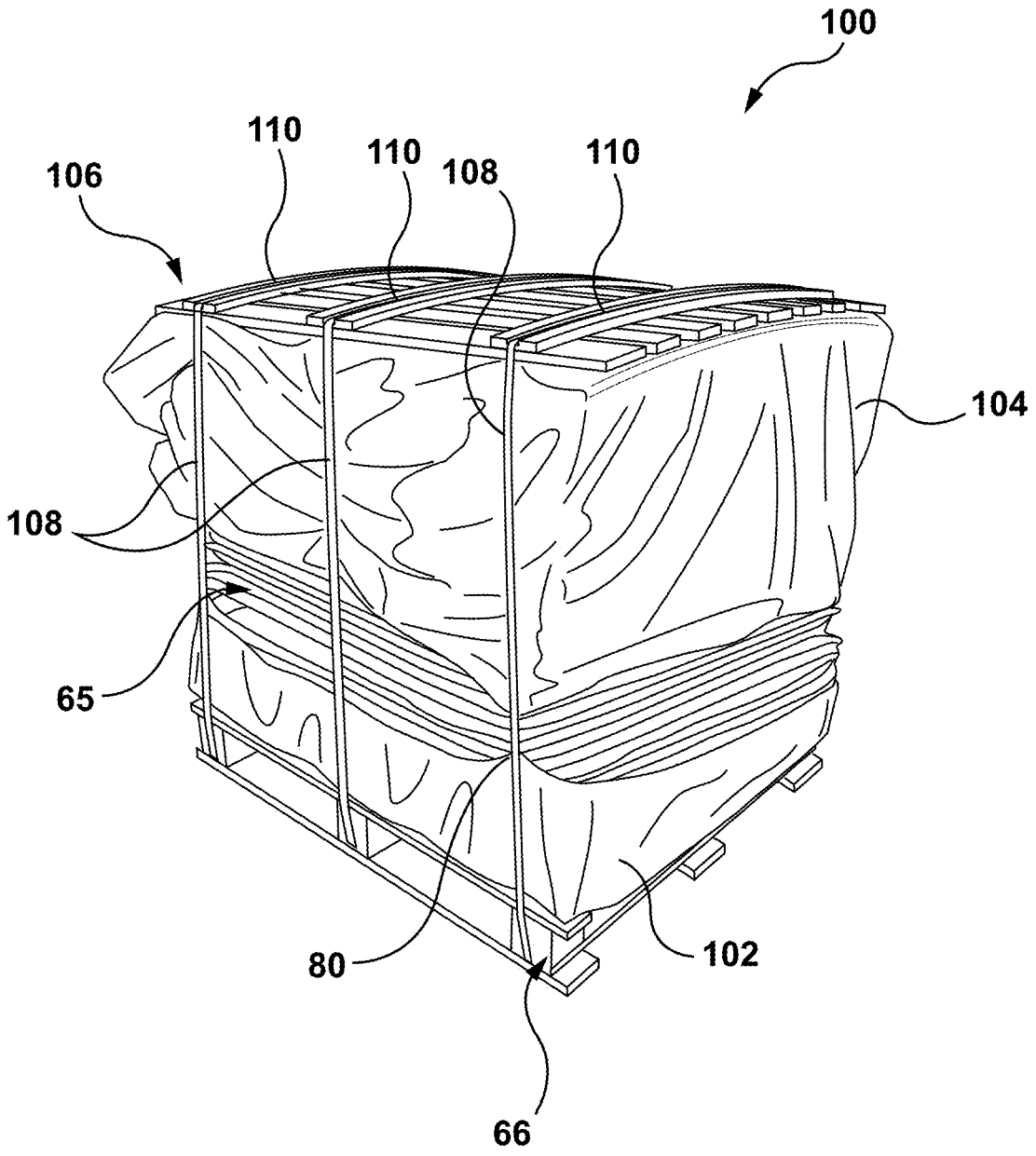
FIG. 5 illustrates a plurality of the folded container bags of FIG. 3 including the respective inserts, stacked on a pallet, according to an embodiment of the present disclosure.
Figure 7:
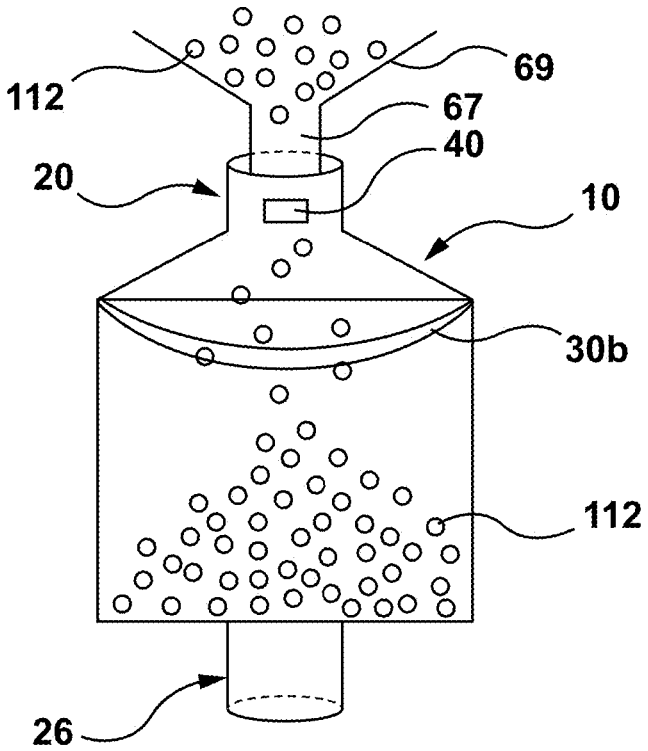
FIG. 7 illustrates the unfolded flexible container bag of FIG. 6 and engaged with a filling tube of a hopper.

Flexible bulk containers are typically provided to filling sites as a stack 65 of folded flexible bulk containers 10, positioned one on top of another, on a pallet 66 (FIG. 5). Unlike in systems of the prior art, in the present disclosure, embodiments of the present flexible bulk container 10, such as described above, and its manner of folding, in certain embodiments, allows a robotic system, such as the robotic system 46, to automatically unpack the uppermost folded flexible bulk container 10 in the stack 65 of folded flexible bulk containers 10 and position them for engagement with a filling hose 67 of a hopper 69 (FIG. 7) for filling with the bulk material. In certain embodiments, the flexible bulk container 10 allows for automatic unpacking of a stack 65 of flexible bulk containers 10 using the robotic system 46.

Detection of the location of the position marker 40 on the flexible bulk container 10 provides information to the robotic system 46 to allow accurate positioning of the robotic arms 50, 52 for lifting the flexible bulk container 10 from the stack 65 of flexible bulk containers 10. In this respect, the flexible bulk container 10 is arranged to be folded in such a way as to lay flat the filling spout 20 on the side wall 16*a* of the flexible bulk container 10 when the flexible bulk container is empty 10 and folded. The filling spout 20 and position marker 40 are arranged to present a substantially flat upwardly facing outer surface 42 in order to minimise or eliminate the distortion of the visual appearance of the position marker 40. It will be appreciated that creases or folds of the position marker 40 or the outer surface 42 of the filling spout 20 to which the position marker is attached 40 may hinder the accurate positioning of the robotic arms 50, 52 due to an inaccurate detection of the location of the position marker 40 by the detector 44.

In this respect, the filling spout 20 comprises a material having a sufficient stiffness to present a substantially flat upwardly facing outer surface 42 when the flexible bulk container 10 is empty and is folded. In this embodiment, this is achieved through a combination of fabric weight and lamination. The inventors have found that by forming the filling spout 20 from a material having a higher stiffness than the conventional 70 g/m$^2$, and by laminating, it is possible to minimise or eliminate creases or wrinkles in the position marker 40, and/or the surrounding material of the filling spout 20, whilst balancing this functionality with production costs (the thicker the material used, the higher cost per unit of flexible bulk container).

The weight of the fabric of the filling spout 20 is more than the weight of the fabric of the discharge spout 26. The weight of the fabric of the filling spout 20 is less than the weight of the fabric of the side walls 16*a*, 16*b*, 16*c* and 16*d*, and the bottom wall 14 of the flexible bulk container 10. In this embodiment, the weight of the fabric of the discharge spout 26 is 70 g/m$^2$, and the weight of the fabric of the side walls 16*a*, 16*b*, 16*c* and 16*d* of the flexible bulk container is 200 g/m$^2$. The weight of the fabric of the filling spout 20 is between about 70 to about 200 g/m$^2$, about 70 to about 240 g/m$^2$, about 75 to about 240 g/m$^2$, about 75 to about 230 g/m$^2$, about 75 to about 220 g/m$^2$, about 75 to about 210 g/m$^2$, about 75 to about 190 g/m$^2$, about 75 to about 180 g/m$^2$, about 75 to about 170 g/m$^2$, about 75 to about 160 g/m$^2$, about 75 to about 150 g/m$^2$, about 75 to about 140 g/m$^2$, about 75 to about 135 g/m$^2$, about 75 to about 130 g/m$^2$, about 100 to about 150 g/m$^2$, about 110 to about 140 g/m$^2$. Specifically, in this embodiment, the weight of the fabric of the filling spout 20 is about 135 g/m$^2$. The top wall has a weight of about 70 g/m$^2$.

The lamination is a layer of transparent material on the outer surface of the filling spout 20. In this embodiment, the lamination is a polyethylene layer. In other embodiments, other suitable materials can be used as the laminate. The weight of the lamination is about 30 g/m$^2$.

Pockets 68 (FIG. 1) are provided on two oppositely facing side walls 16*a*, 16*c* of the flexible bulk container 10 for housing labels or documentation. The pockets 68 are polypropylene sheets which are laminated on an outer surface and attached to the respective side wall 16*a*, 16*c* by stitching. When viewed from the front end 32 (FIG. 1A), one of the pockets 68 is positioned on the side wall 16*a* at the front end 32 of the flexible bulk container 10, and the other pocket 68 is positioned on the side wall 16*c* at the back end 34 of the flexible bulk container 10. The pockets 68 are both positioned to one side of the filling spout 20. As seen in FIG. 1B, the pockets are positioned on the left side of the longitudinal marker 58 side of the filling spout 20 and the tie 25. This configuration can provide ease of folding, as will be described below. In other embodiments, the flexible bulk container 10 includes only one pocket 68 or no pockets. The pockets can be made of any other material.

Figure 2A:
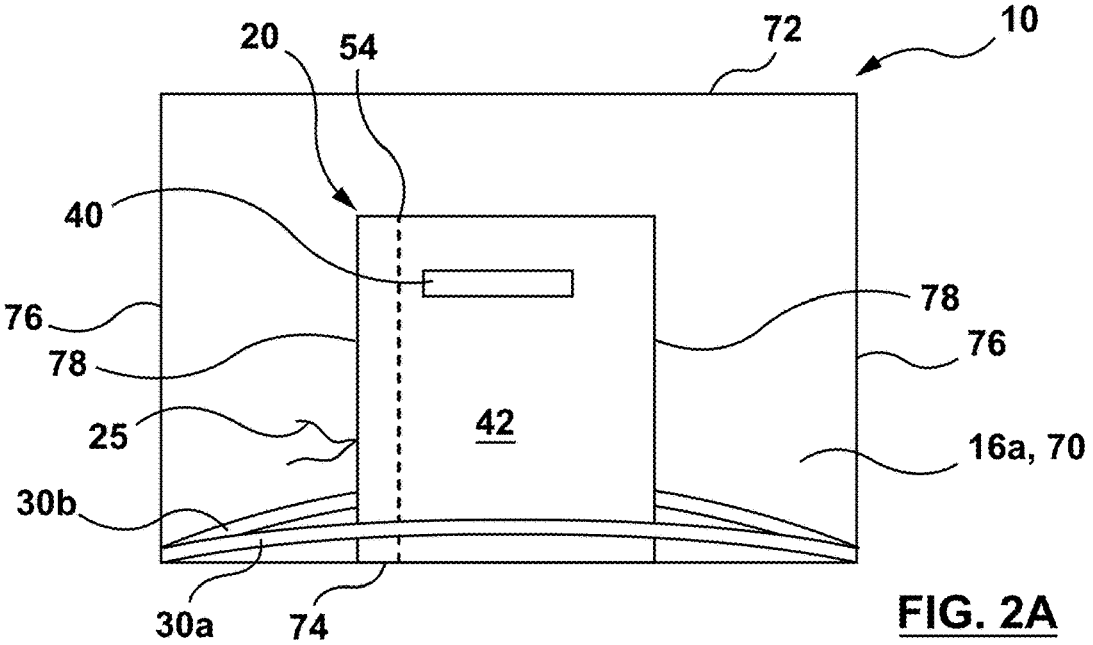
FIG. 2A is the flexible container bag of FIG. 1, in a folded state, and when viewed from an upper fold face of the folded flexible container bag, according to an embodiment of the present disclosure.
Figure 2B:
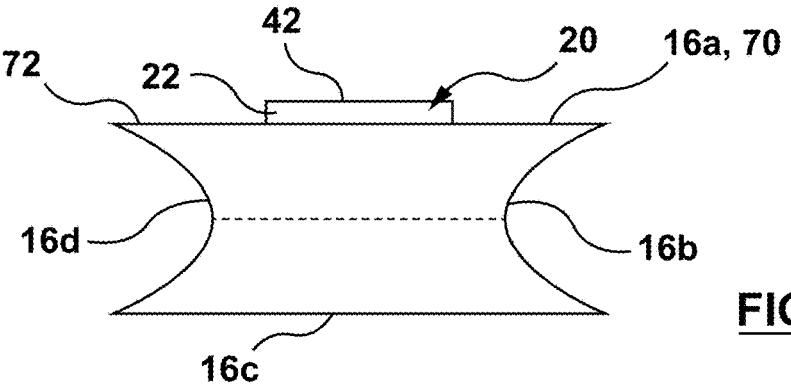
FIG. 2B is the folded flexible container bag of FIG. 2A when viewed from an upper fold end of the folded flexible container bag, according to an embodiment of the present disclosure.
Figure 3:
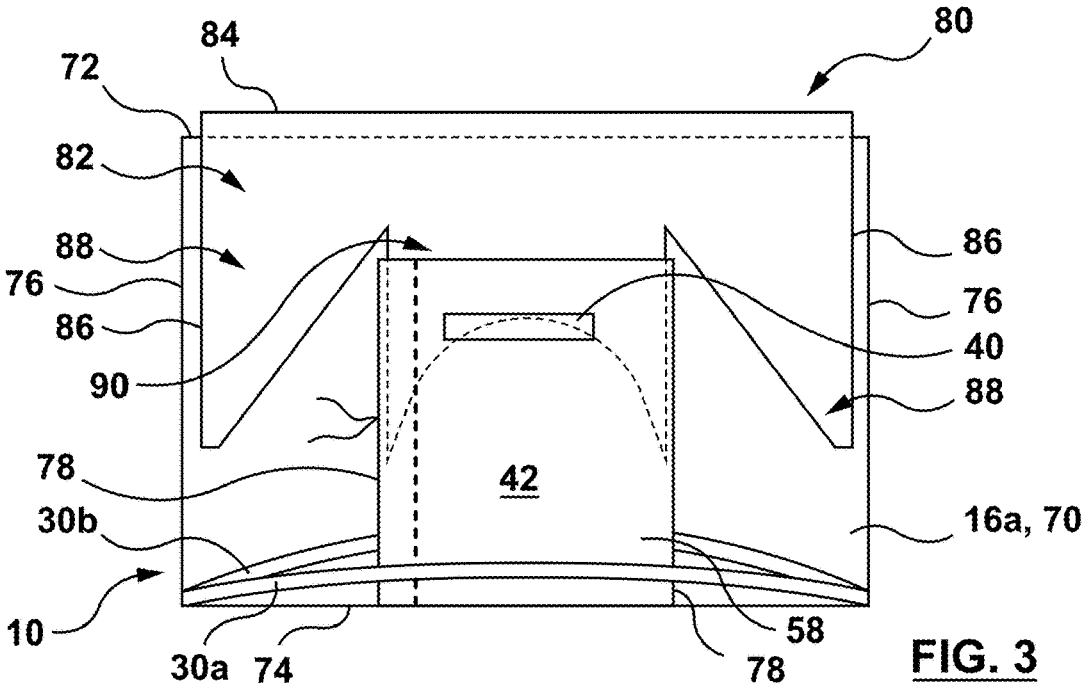
FIG. 3 is the folded flexible container bag of FIG. 2A including an insert, according to an embodiment of the present disclosure.

Referring now to FIGS. 2A, 2B and 3, in which the flexible bulk container 10 of FIG. 1 is illustrated in a folded state. The folded flexible bulk container 10 has an upper fold face 70, an upper fold edge 72, a lower fold edge 74 and two oppositely facing side fold edges 76. The flexible bulk container 10 is folded such that the filling spout 20 is folded flat on the upper fold face 70 with the position marker 40 facing upwardly. The flexible bulk container 10 is folded such that the side wall 16*a* becomes the upper fold face 70 in the folded flexible bulk container 10. In other words, the filling spout 20 is folded from the filling spout base 24 towards the bottom wall 14 and laid flat against the side wall 16*a* such that the longitudinal marker 58 extends along a filling spout side edge 78. The lifting loops 30*a*, 30*b* are positioned one above the folded filling spout 20, and one beneath the folded filling spout 20. As best seen in FIG. 2B showing the folded flexible bulk container 10 when viewed from an upper fold end, the side wall 16*a* lies against the side wall 16*c*, with the side walls 16*b*, 16*d* and the bottom wall 14, folded inwardly and sandwiched between side walls 16*a* and 16*c*.

The flexible bulk container 10 is folded so that the upper fold face 70 is dimensioned to fit onto the pallet 66, or have folded dimensions less than a surface area of the pallet (FIG. 5). In this embodiment, a standard pallet size is about 100×120 cm, and so the upper and lower fold edges 72, 74 and side fold edges are about 116 to about 120 cm and about 96 to about 100 cm, or about 118 cm and 98 cm, respectively. The folded flexible bulk containers 10 are stacked, one on top of one another, with the upper fold face 70 and the position marker 40 facing upwardly on the pallet 66. In order to achieve a more efficient stacking, each folded flexible bulk container 10 in the stack 65 is oriented at approximately 180° relative to an adjacent folded flexible bulk container 10 in the stack 65, i.e. a folded flexible bulk container immediately above or below the flexible bulk container 10. Each one of the flexible bulk containers 10 of the stack 65 has a lower fold face and the flexible bulk containers 10 of the stack 65 are stacked such that the lower fold face of one flexible bulk container 10 lies against the upper fold face 70 of an adjacent flexible bulk container 10. In alternative embodiments, each folded flexible bulk container 10 in the stack 65 is oriented at approximately 90°, instead of 180°, relative to an adjacent folded flexible bulk container 10 in the stack 65.

For the accurate positioning of the robotic arms 50, 52 on the uppermost folded flexible bulk container 10 of the stack 65, in certain embodiments, it is desired for the position marker 40 to be consistently positioned with respect to the side fold edges 76 and the upper fold edge 72, and to maintain this position during stacking of the folded flexible bulk containers 10. In this respect an insert 80 is provided (FIGS. 3, 4 and 6) which is sized and shaped to position and maintain the folded filling spout 20 at a predetermined position relative to the side fold edges 76 and the upper fold edge 72 of the flexible bulk container 10. The insert 80 is removeably positionable in the folded flexible bulk container 10. In use, the insert 80 will be discarded by the robotic system 46 once the robotic arm 50 has correctly gripped the uppermost folded flexible bulk container 10 from the stack 65 of flexible bulk containers 10 and removed it from the stack 65. The insert 80 is made of cardboard. In other embodiments, the insert 80 is re-usable and made of a polymer such as a polyethylene, or made of a metal alloy such as an aluminium alloy, or comprises any other metal or polymer sheet. The insert 80 is made of a material of sufficient stiffness to avoid folding when inserted in the filling spout 20.

The insert 80 comprises a head portion 82 extending between an insert upper edge 84 and insert side edges 86. Lateral spacer portions 88 extend from the head portion 82 along each of the insert side edges 86. A tail portion 90 also extends from the head portion 82, between the two lateral spacer portions 88, and is arranged to be received in the open end 22 of the filling spout 20. A longitudinal axis of the lateral spacer portions 88 and/or the tail portion 90 is substantially perpendicular to a longitudinal axis of the head portion 82. The two lateral spacer portions 88 have the same width as each other and are arranged to space the filling spout 20 equidistantly from the side fold edges 76 of the folded flexible bulk container 10 when the flexible bulk container 10 is empty and folded. In this respect, each lateral spacer portion 88 has the same width.

The tail portion 90 is sized and shaped for insertion into the folded filling spout 20. The tail portion 90 has a width, defined by a distance between two tail portion side edges 91*a*, 91*b*, sufficient to allow it to be received in the filling spout 20 and wide enough to maintain at least a portion of the filling spout 20 substantially flat when the filling spout 20 is folded, with the tail portion 90 received in the filling spout 20 when the flexible bulk container 10 is empty and folded. The width of the insert 80 is the same or slightly smaller than the distance between the side fold edges 76 of the folded flexible bulk container 10. The insert 80 upper edge 84 is substantially perpendicular to one or more of the tail 90 side edges or the insert side edges 86.

In this embodiment, the flexible bulk container has body dimensions of about 110×110×112 cm and the filling spout 20 has a diameter of about 41 cm, and a height of about 61 cm. A distal end of the tail portion 90 has a pronged or concave configuration. Other distal end cut-out shapes and configurations are possible for reducing a total weight of the insert. A width of the insert 80 is the same or slightly smaller than the distance between the side fold edges 76 of the folded flexible bulk container 10. In this embodiment, the width of the tail portion 90 of the insert 80 is about 60 cm. It will be appreciated that the size and dimensions of the insert 80 can vary from the figures provided herein, and in accordance with the size and dimensions of the flexible bulk container 10 with which it will be used.

As seen in FIG. 3, when the insert 80 is placed with the tail portion 90 inserted into the open end 22 of the filling spout 20, the head portion 82 and the lateral spacer portions 88 lie on the upper fold face 70 (side wall 16*a*). The outer edge 54 of the filling spout 20 at the filling spout side edges 78 abuts the insert 80 at the junctions where each one of the lateral spacer portions 88 meet the tail portion 90. The head portion 82 protrudes away from the outer edge 54 to facilitate the gripping of the insert 80 and the head portion 82. In use, the insert 80 will be gripped and discarded by the robotic arm 52, once the flexible bulk container 10 has been removed from the stack 65 of flexible bulk containers 10. The insert upper edge 84 may be substantially flush with the upper fold edge 72. This depends on the size and the dimensions of the flexible bulk container 10.

Figure 4A:
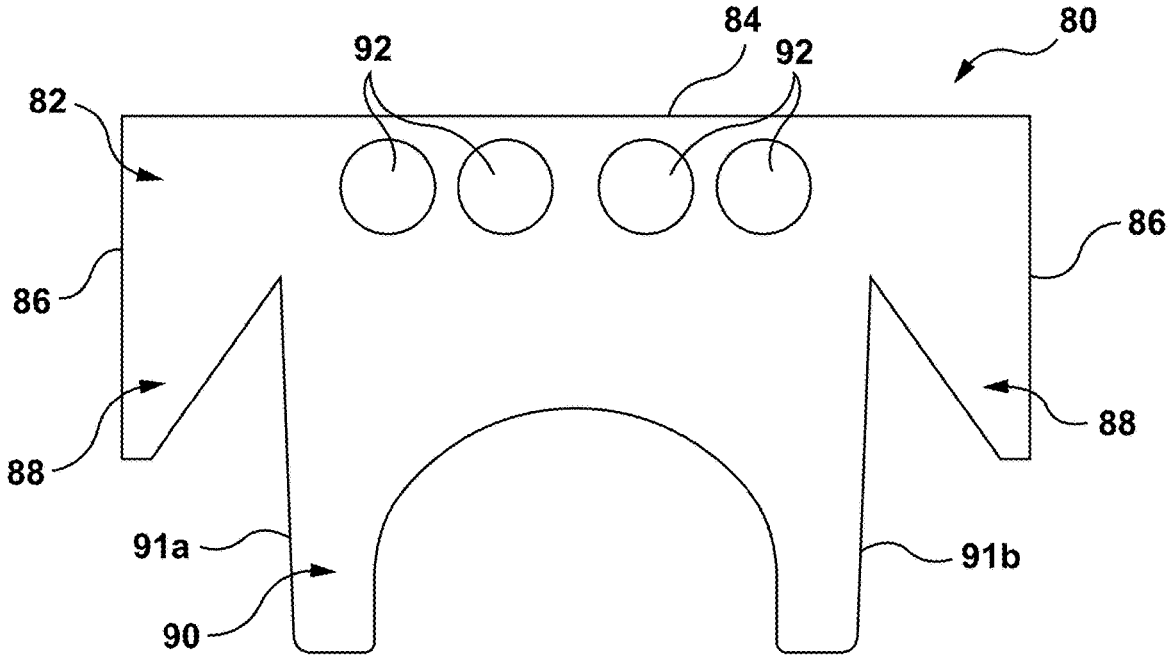
FIGS. 4A, 4B, and 4C illustrate the insert of FIG. 3, according to different embodiments of the present disclosure.

In FIG. 4A, there is shown an embodiment of the insert 80 which differs from that of FIG. 3, in that four circular openings 92 are provided in the head portion 82 and aligned with respect to each other in a direction generally parallel to, and along, the insert upper edge 84. The openings can reduce the weight of the insert 80, and hence the total weight of the stacked flexible bulk containers 10 even further. In certain embodiments, the openings 92 can also facilitate flat stacking of the folded flexible bulk containers 10. The insert 80 of FIG. 4A can be used with any size of flexible bulk container 10 and filling spout 20, such as those with dimensions of about 110×110×72 cm and about 110×110×158 cm.

Figure 4B:
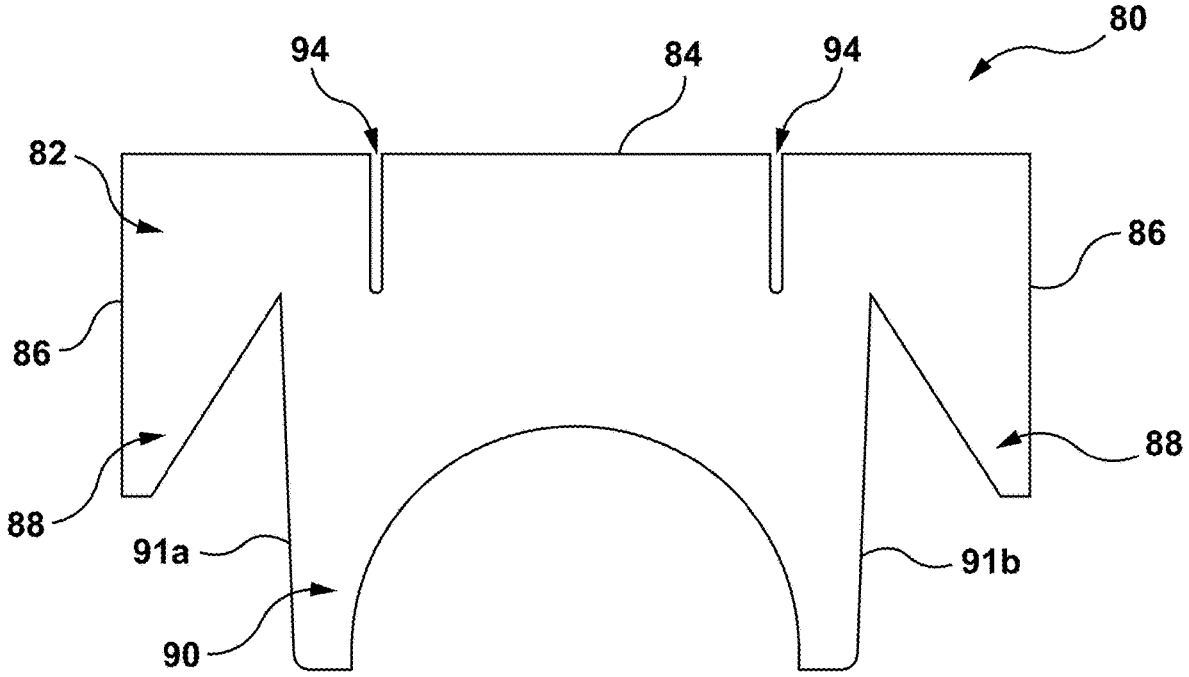

In FIG. 4B, there is shown an embodiment of the insert 80 which differs from that of FIG. 4A, in that instead of the four circular openings 92, there are provided two slots 94 extending transversely from the insert upper edge 84 towards the tail portion 90. In certain embodiments, these inserts 80 are particularly well suited for flexible bulk containers 10 having a longer length of body, such as flexible bulk containers with the dimensions 110×110×112 cm, or longer than 112 cm. When this larger flexible bulk container 10 is folded as before with the filling spout 20 laying on the upper fold face 70 (corresponding to the side wall 16*a*), the upper fold face 70 is longer than a standard pallet size. Therefore, to facilitate the folded flexible bulk container 10 fitting on the standard pallet 66, the additional length is folded over the insert upper edge 84 and inserted into the slots 94 to hold them in position. In this embodiment, the insert 80 can therefore provide an additional functionality of sizing the folded flexible bulk container 10 to fit on a desired size of pallet 66.

Figure 4C:
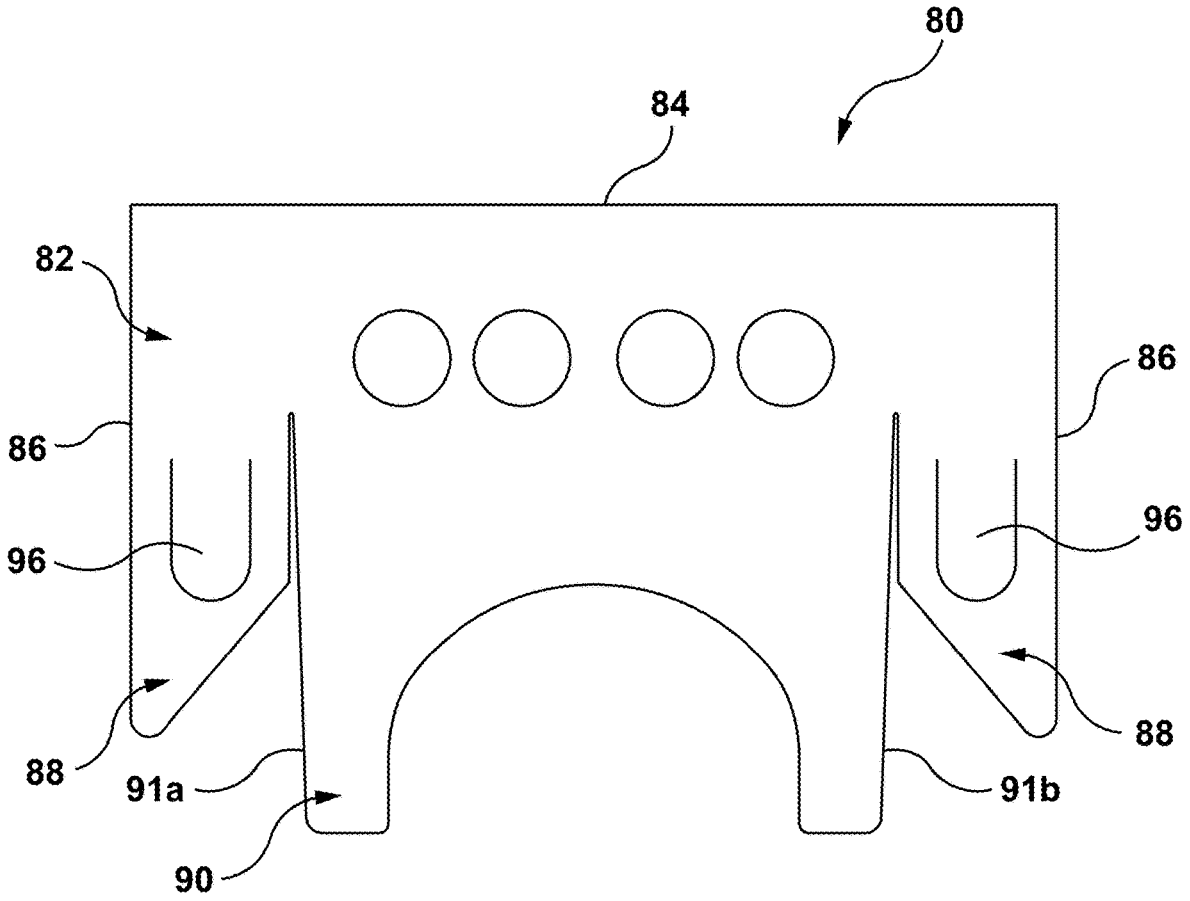

In FIG. 4C, there is shown an embodiment of the insert 80 which differs from that of FIG. 4A, in that the insert 80 is adapted to be used with flexible bulk containers 10 having a shorter length of body, which when folded is less than the dimensions of the pallet 66. For example, the insert 80 of FIG. 4C can be used with flexible bulk containers 10 with the dimensions of about 110×110×59 cm. When this smaller size flexible bulk container 10 is folded as before with the filling spout 20 laying on the upper fold face 70 (corresponding to the side wall 16*a*), the upper fold face 70 falls short of the pallet 66 size. Therefore, the head portion 82 is sized to extend the dimensions of the upper fold face 70 of the folded flexible bulk container 10 to fit the pallet 66. Flaps 96 are provided on the lateral spacer portions 88, to engage with the upper fold edge 72.

For convenient transportation, the stack 65 of folded flexible bulk containers 10 can be prepared as a package 100 (FIG. 5). The package 100 comprises a plurality of folded flexible bulk containers 10 stacked in a head-to-tail configuration (each folded flexible bulk container 10 is oriented approximately 180° with respect to each adjacent folded flexible bulk container 10). In other words, each folded flexible bulk container 10 of the stack 65 has an orientation, the orientation of two adjacent folded flexible bulk containers 10 being approximately 180° relative to each other. In alternative embodiments, the orientation of consecutive folded flexible bulk containers is about 90°. A lower cover 102 sits on the pallet 66 and houses a number of lower-most folded flexible bulk containers 10. The lower cover 102 has a base and four sides extending from the base. In this embodiment, the sides extend at least partially upwardly from the base, for example at a height of approximately 35 cm. An upper cover 104 covers the folded flexible bulk containers 10 and extends from the upper-most folded flexible bulk container 10 towards the lower-most folded flexible bulk container 10. The upper cover 104 has a roof and four sides extending from the roof. The upper cover sides extend at least partially downwardly from the uppermost folded flexible bulk container. In this embodiment, the height of the upper cover sides are sufficient to cover the entire stack 65 including overlapping with at least a portion of the lower cover 102 sides. A rack 106 is positioned over the upper-most folded flexible bulk container 10 and the upper cover 100. The pallet 66 is connected to the rack 106 by outer straps 108. The pallet 66 and the rack 106 sandwich the stack 65 of folded flexible bulk containers. It will be appreciated that the tightness of the inner straps and/or the outer straps 108 are selected so as not to substantially disturb the shape or form of the folded flexible bulk containers.

This package 100 configuration, which is essentially a wrapped stack 65, can avoid or minimise damage to the folded flexible bulk containers 100 in the stack 65. For example, the outer straps 108 do not directly touch the folded flexible bulk containers 10. Also, the rack 106 can help to keep the folded flexible bulk containers in their compressed and/or flattened form. An outer cover (not shown) with labelling (not shown), is provided over the rack 106 leaving only a portion of the pallet 66 exposed for engagement with a forklift of a forklift truck (not shown) to transport the stack 65. Any one or more of the lower cover 102, the upper cover 104 or the outer cover are made from a polymer sheeting such as polyethylene or polypropylene. The pallet 66 and the rack 106 are made of wood. The rack has guides 110 extending across the rack 106 for retaining a position of the outer straps 108. The guides comprise channels extending across the rack for receiving at least a portion of the outer straps. As best seen in FIG. 5, in this embodiment, three straps are provided around the pallet 66 and the rack 106 sandwiching the stack 65. In other embodiments, the pallet 66, the rack 106, the lower cover 102, the upper cover 104 or the outer cover may be made of other suitable materials. Any one or more of the lower cover 102, the upper cover 104 or the outer cover may be omitted.

The package 100 is formed as follows. Once the flexible bulk container 10 has been folded with the insert 80 in position, it is placed into a pressing machine (not shown), and other folded flexible bulk containers 10 are placed individually one on top of each other to form a stack 65 of folded flexible bulk containers 10. As mentioned earlier, the orientation of each folded flexible bulk container 10 is at 180° to an adjacent folded flexible bulk container 10. In other words, each folded flexible bulk container 10 is alternately oriented relative to an adjacent folded flexible bulk container 10 in the stack 65. The stack 65 of folded flexible bulk containers 10 is then compressed to reduce a height of the stack 65. In this embodiment, the stack 65 comprises one hundred and twenty five (125) folded flexible bulk containers 10, which are compressed by the pressing machine in batches of 30-35 folded flexible bulk containers 10. In other embodiments, the stack 65 comprises more or less than one hundred and twenty five (125) folded flexible bulk containers 10. The insert 80 used with each folded flexible bulk container 10 can help to maintain the position of the position marker 40 relative to the upper fold face 70, as well as minimising or avoiding creases in the position marker 40 and the surface 42 of the filling spout 20 on which the position marker 40 is located. Two inner straps (not shown) are passed around the stack 65 whilst under compression to maintain the compressed height of the stack 65. The compressed stack 65 is then removed from the pressing machine and placed into the lower cover 102 which is on the pallet 66. The upper cover 104 is then placed over the stack 65 whilst the inner straps are still in position. The rack 106 is then placed on the upper cover 104, and the rack 106 and the pallet 66 connected together by the outer straps 108. Once the outer straps 108 are in position, the inner straps can be cut and removed. This can avoid prolonged contact of the folded flexible bulk containers 10 with any straps thereby minimising or avoiding damage to the folded flexible bulk containers.

Referring now to FIG. 6, in use, the package 100 once transported to a filling site is unwrapped, and the stack 65 of folded flexible bulk containers on the pallet 66 positioned in the vicinity of the detector 44 of the robotic system 46. The processor 48 includes various instructions relating to the functions of the robotic arms 50, 52. The detector 44 will read the uppermost folded flexible bulk container of the stack 65, and send the information to the processor 48 which will determine the orientation of the uppermost folded flexible bulk container and control the robotic arm 50 so that it grips the uppermost folded flexible bulk container.

The processor 48 will control the robotic arm 50 according to preprogrammed coordinates of where to move the robotic arm 50 relative to the position marker 40. The robotic arm 50 is positioned so that it grips the uppermost folded flexible bulk container but does not grip the insert 80. In this embodiment, the robotic arm grips the flexible bulk container 10 at the filling spout 20 at a level beneath the position marker 40 towards the base 56 of the filling spout 20. The robotic arm 50 comprises a pincher-type mechanism having two contact surfaces which are moveable relative to each other. The robotic arm 50 is arranged to grip the filling spout 20 such that the contact surfaces touch the outer surface 42 of the filling spout 20, one on the upwardly facing side with the position marker 40 visible, and the other contact surface on an underside of the filling spout 20 (facing the upper fold face 70). In this way, when the robotic arm 50 moves upwardly whilst gripping the filling spout 20, the uppermost folded flexible bulk container 10 is removed from the stack 65 of folded flexible bulk containers, and is able to unfold itself as the robotic arm 50 lifts it away from the stack. The processor controls the second robotic arm 52 to grip the insert 80 at the head portion 82 which extends from the folded flexible bulk container 10. As the processor 48 has been preprogrammed with distance of the head portion 82 of the insert 80 from the position marker, the processor 48 is able to direct the robotic arm 52 to grip the insert, and to remove and discard the insert 80. The filling spout 20 is then engaged with the filling hose 67 for filling with material 112. The material 112 is illustrated as having particulate form in this embodiment but in other embodiments can have any other form. Once filled, the filled flexible bulk container 10 can be treated in a usual manner.

In other embodiments, the uppermost flexible bulk container 10 can be unpacked from the stack in any other suitable way and using any other suitable means, such as any number and configuration of robotic arms or the like. The robotic system 46 system can be part of a filling system and can take any form.

Variations and modifications will occur to those of skill in the art after reviewing this disclosure. The disclosed features may be implemented, in any combination and subcombinations (including multiple dependent combinations and subcombinations), with one or more other features described herein. The various features described or illustrated above, including any components thereof, may be combined or integrated in other systems. Moreover, certain features may be omitted or not implemented. Examples of changes, substitutions, and alterations are ascertainable by one skilled in the art and could be made without departing from the scope of the information disclosed herein. For example, instead of a filling spout 20, any other access portion can be provided on the flexible bulk container 10, such as a skirt. The filling spout 20 and the discharge spout 26 may take any other form.

The flexible bulk container can be of any suitable size, shape and configuration for any intended purpose. For example, the flexible bulk container 10 can have an external body of about 110×110×59 cm and a filling spout 20 height of about 71 cm; a body of about 110×110×72 cm and a filling spout 20 height of about 66 cm; or a body of about 110×110×158 cm and a filling spout 20 height of about 61 cm. The weight of the material of the body and the filling spout 20 can be adapted for any intended use. For example, a larger sized flexible bulk container 10 can be made of a heavier weight of material due to the increased weight that it will need to support. The flexible bulk container 10 can be made of any suitable material and using any method, such as by weaving.

The flexible bulk container 10 can be folded in any suitable manner for stacking on a pallet 66, or the like. For example, instead of folding the filling spout 20 onto the side wall 16*a*, the filling spout 20 can be folded onto any other part of the flexible bulk container 10. For example, the filling spout 20 can be folded from the top wall 12 instead of the filling spout base 56.

For detection of the position marker 40 and positioning of the robotic arm 50, in certain embodiments, it is preferred to have the position marker 40 upwardly facing on the upper fold face 70. In other embodiments where the position marker 40 is not a visual marker, the position marker need not be necessarily upwardly facing in the folded flexible bulk container 10. In certain embodiments, it is preferred to have the filling spout 20 positioned on the upper fold face 70 of the folded flexible bulk container 10 so that the robotic arm 50 can easily grip the folded flexible bulk container 10 by the filling spout 20. In other embodiments, the filling spout 20 can be positioned in any other convenient way in the folded flexible bulk container 10.

It should be appreciated that the invention is not limited to the particular embodiments described and illustrated herein but includes all modifications and variations falling within the scope of the invention as defined in the appended claims.

What is claimed is:

1. A flexible bulk container comprising:

a top wall, a bottom wall, and at least one sidewall, the top wall, bottom wall and the at least one sidewall defining an internal space;

an access portion associated with the top wall for accessing the internal space through an open end of the access portion;

a position marker located at a predetermined position on the access portion for detection by a detector of a robotic system; and a removeable insert which is sized and shaped to position the access portion at a predetermined position relative to at least one of an upper fold edge, a lower fold edge or side fold edges of the flexible bulk container, when the flexible bulk container is empty and folded with the access portion laying on an upper fold face of the folded flexible bulk container.

2. The flexible bulk container of claim 1, wherein the predetermined position of the position marker is a distance or an x, y coordinate relative to at least one reference point on the access portion.

3. The flexible bulk container of claim 2, wherein the at least one reference point is on one or more of the open end of the access portion, a side edge of the access portion, a longitudinal mark along a longitudinal dimension of the access portion, an intersection of the open end and the side edge of the access portion, and an intersection of the open end and the longitudinal mark of the access portion.

4. The flexible bulk container of claim 1, wherein the position marker is a visually detectable mark.

5. The flexible bulk container of claim 1, wherein the insert comprises: a head portion, and a tail portion extending from the head portion, for spacing the access portion from the upper fold edge of the folded flexible bulk container, the head portion having an insert upper edge and the tail portion being sized and shaped for engagement with the open end of the access portion, and lateral spacer portions extending from the head portion, one on either side of the tail portion, for spacing the access portion from the side fold edges of the folded flexible bulk container when the flexible bulk container is empty and folded.

6. The flexible bulk container of claim 1, wherein at least a portion of the access portion on which the position marker is located has a stiffness sufficient to present a substantially flat upwardly facing surface when the flexible bulk container is empty and is folded.

7. The flexible bulk container of claim 6, wherein the at least a portion of the access portion on which the position marker is located is formed from a fabric having a weight of between about 70 to about 200 g/m$^2$, about 70 to about 240 g/m$^2$, about 70 to about 230 g/m$^2$, about 70 to about 220 g/m$^2$, about 70 to about 210 g/m$^2$, about 75 to about 240 g/m$^2$, about 75 to about 230 g/m$^2$, about 75 to about 220 g/m$^2$, about 75 to about 210 g/m$^2$, 75 to about 190 g/m$^2$, about 75 to about 180 g/m$^2$, about 75 to about 170 g/m$^2$, about 75 to about 160 g/m$^2$, about 75 to about 150 g/m$^2$, about 75 to about 140 g/m$^2$, about 75 to about 135 g/m$^2$, about 75 to about 130 g/m$^2$, about 100 to about 150 g/m$^2$, about 110 to about 140 g/m$^2$, or about 135 g/m$^2$.

8. The flexible bulk container of claim 6, wherein the at least a portion of the access portion on which the position marker is located is laminated.

9. The flexible bulk container of claim 1, wherein at least a portion of the access portion on which the position marker is located has a stiffness sufficient to present a substantially flat upwardly facing surface when the flexible bulk container is empty and is folded, the at least a portion of the access portion on which the position marker is located being made of a fabric having a weight of about 70 to about 240 g/m$^2$ or about 75 to about 150 g/m$^2$, and the at least a portion of the access portion on which the position marker is located being laminated.

10. The flexible bulk container of claim 1, wherein the access portion is a filling spout extending from the top wall, at least a portion of the filling spout on which the position marker is located being laminated and/or being formed from a fabric having a weight of between about 70 to about 240 g/m$^2$, the predetermined position of the position marker being a distance from one or more of the open end of the filling spout, a side edge of the filling spout when the filling spout is folded flat, a longitudinal mark along a longitudinal dimension of the filling spout, an intersection of the open end of the filling spout and the side edge of the filling spout, and an intersection of the open end of the filling spout and the longitudinal dimension of the filling spout.

11. The flexible bulk container of claim 10, wherein the insert comprising: a head portion with an insert upper edge, a tail portion extending from the head portion for insertion into the open end of the filling spout, and lateral spacer portions extending from the head portion, one on either side of the tail portion, the tail portion having a width, defined by a distance between two tail portion side edges, sufficient to allow it to be received in the filling spout and wide enough to maintain at least a portion of the filling spout substantially flat, when the tail portion is received in the filling spout when the flexible bulk container is empty and folded.

12. The flexible bulk container of claim 11, wherein the insert further comprises one or more features selected from: slots extending from the insert upper edge towards the tail portion for receiving at least one folded portion of the folded flexible bulk container; holes defined in the head portion; and a flap on at least one of the lateral spacing portions for engagement with at least one folded portion of the folded flexible bulk container.

13. The flexible bulk container of claim 10, wherein the position marker is a visual mark having a contrasting colour to that of the outer surface of the filling spout, and is attached to or formed on the outer surface of the filling spout.

14. A stack of flexible bulk containers comprising a plurality of flexible bulk containers, each flexible bulk container comprising:

a top wall, a bottom wall, and at least one sidewall, the top wall, bottom wall and the at least one sidewall defining an internal space;

an access portion associated with the top wall for accessing the internal space through an open end of the access portion;

a position marker located at a predetermined position on the access portion for detection by a detector of a robotic system; and a removeable insert which is sized and shaped to position the access portion at a predetermined position relative to at least one of an upper fold edge, a lower fold edge or side fold edges of the flexible bulk container, when the flexible bulk container is empty and folded with the access portion laying on an upper fold face of the folded flexible bulk container;

each flexible bulk container having a folded form comprising an upper fold edge, a lower fold edge and two side fold edges, with the access portion folded and laying on an upper fold face of the folded flexible bulk container, the position marker on the access portion facing outwardly, each one of the plurality of the flexible bulk containers of the stack laying one on top of another.

15. The stack of claim 14, wherein each one of the plurality of flexible bulk containers of the stack has a lower fold face and the flexible bulk containers of the stack can be stacked such that the lower fold face of one flexible bulk container lies against an upper fold face of an adjacent flexible bulk container, and with the upper fold face of each one of the flexible bulk container of the stack oriented alternately, relative to an adjacent one of the flexible bulk container of the stack.

16. The stack of claim 14, wherein the removeable insert comprising: a head portion, and a tail portion extending from the head portion, for spacing the access portion from the upper fold edge of the folded flexible bulk container, the head portion having an insert upper edge and the tail portion being sized and shaped for engagement with the open end of the access portion, and lateral spacer portions extending from the head portion, one on either side of the tail portion, for spacing the access portion from the side fold edges of the folded flexible bulk container when the flexible bulk container is empty and folded.

17. The stack of claim 14, further comprising a pallet on which the plurality of flexible bulk containers are stacked, a rack positioned over an upper-most folded flexible bulk container, and at least one outer strap connecting the pallet and the rack.

18. The stack of claim 17, further comprising at least one cover extending over the folded flexible bulk containers and positioned under or over the at least one outer strap.

19. A flexible bulk container comprising:

a top wall, a bottom wall, and at least one sidewall, the top wall, bottom wall and the at least one sidewall defining an internal space;

a filling spout extending from the top wall and having one open end in fluid communication with an opening in the top wall for accessing the internal space through the filling spout;

a position marker detectable by a detector of a robotic system, the position marker located on the filling spout and at a predetermined distance from the open end of the filling spout, an insert arranged to locate the position marker at a predetermined position relative to at least one of an upper fold edge, a lower fold edge or side fold edges of the flexible bulk container, when the flexible bulk container is empty and folded with the filling spout folded onto an upper fold face of the flexible bulk container.

* * * * *